US009964022B2

(12) United States Patent
Gonze et al.

(10) Patent No.: US 9,964,022 B2
(45) Date of Patent: May 8, 2018

(54) ENGINE OFF COOLING STRATEGY

(71) Applicant: GM Global Technology Operations LLC, Detroit, MI (US)

(72) Inventors: Eugene V. Gonze, Pickney, MI (US); Yue-Ming Chen, Ann Arbor, MI (US); Vijay Ramappan, Novi, MI (US); Christopher Harold Knieper, Chesaning, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 434 days.

(21) Appl. No.: 14/669,097

(22) Filed: Mar. 26, 2015

(65) Prior Publication Data

US 2016/0281584 A1 Sep. 29, 2016

(51) Int. Cl.
*F01P 11/16* (2006.01)
*F01P 3/20* (2006.01)

(52) U.S. Cl.
CPC ..... *F01P 11/16* (2013.01); *F01P 3/20* (2013.01); *F01P 2031/30* (2013.01); *F01P 2050/24* (2013.01); *F01P 2060/18* (2013.01)

(58) Field of Classification Search
CPC ..... F01P 3/20; F01P 5/10; F01P 7/14; F01P 2007/143; F01P 11/04; F01P 2025/12; F01P 2025/50; F01P 2060/08; F01P 2060/18; F01P 2070/10; F01P 11/16; F01P 2031/30; F02N 11/0814; F02N 11/0833; F02N 11/0837; F02N 11/084; F02D 43/04; F02D 45/00
See application file for complete search history.

(56) References Cited

U.S. PATENT DOCUMENTS 5,553,662 A * 9/1996 Longardner ..... B60H 1/00492 165/10
6,032,869 A * 3/2000 Ito ..... B60H 1/00314 165/103
6,213,233 B1 * 4/2001 Sonntag ..... B60H 1/004 123/142.5 R
6,668,764 B1 * 12/2003 Henderson ..... F01P 7/167 123/41.1
7,237,513 B2 * 7/2007 Pfeffinger ..... F01P 7/162 123/41.29
2002/0035972 A1 * 3/2002 Suzuki ..... B60H 1/00492 123/41.14
2007/0137594 A1 * 6/2007 Boudard ..... B60H 1/00314 123/41.57
2011/0132291 A1 * 6/2011 Ulrey ..... F01P 7/167 123/41.1

(Continued)

*Primary Examiner* — Erick Solis
*Assistant Examiner* — Anthony L Bacon

(57) ABSTRACT

A system includes a coolant management module that, determines whether an engine of a vehicle is off, determines, in response to a determination that the engine is off, whether a heater associated with the engine is on, receives one of a plurality of engine coolant temperature (ECT) measurements and a respective location associated with the received ECT measurement, and communicates the respective location and an instruction to direct engine coolant flow from the respective location to one of the heater and engine. The system also includes a coolant control module that selectively actuates one or more coolant control valves based on the respective location and the instruction.

4 Claims, 3 Drawing Sheets

(56) References Cited

U.S. PATENT DOCUMENTS

| | | | | |
|---|---|---|---|---|
| 2012/0215429 | A1* | 8/2012 | Yumisashi | B60W 10/06 701/112 |
| 2013/0192271 | A1* | 8/2013 | Barnhart | F25B 21/04 62/3.3 |
| 2014/0245975 | A1* | 9/2014 | Quix | F01P 5/10 123/41.08 |
| 2016/0159204 | A1* | 6/2016 | Katoh | B60H 1/3211 62/185 |
| 2017/0096930 | A1* | 4/2017 | Murai | F01P 7/16 |

* cited by examiner

ENGINE OFF COOLING STRATEGY

FIELD

The present disclosure relates to engine temperature control during engine off events.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Vehicles, including, but not limited to, hybrid engine vehicles, may include engine start-stop functionality that stops and starts an internal combustion engine to limit the idle time of the internal combustion engine. For example, the internal combustion engine may be stopped and restarted when the vehicle is not in motion in order to improve fuel economy.

Typically, while the engine is off, thermal energy from the combustion chamber is directed to other system components, such as a cabin heater. Removing thermal energy from the combustion chamber cools cylinder walls and has a damaging effect on fuel efficiency. For example, the engine may be restarted while the engine is cool, resulting in lowered fuel efficiency while the engine warms. Accordingly, a system that meets heating and cooling needs of the vehicle while maximizing cylinder wall temperature and maintaining fuel efficiency benefits is desired.

SUMMARY

A system includes a coolant management module that, determines whether an engine of a vehicle is off, determines, in response to a determination that the engine is off, whether a heater associated with the engine is on, receives one of a plurality of engine coolant temperature (ECT) measurements and a respective location associated with the received ECT measurement, and communicates the respective location and an instruction to direct engine coolant flow from the respective location to one of the heater and engine. The system also includes a coolant control module that selectively actuates one or more coolant control valves based on the respective location and the instruction.

In other features, a method includes determining whether an engine of a vehicle is off, determining, in response to a determination that the engine is off, whether a heater associated with the engine is on, receiving one of a plurality of engine coolant temperature (ECT) measurements and a respective location associated with the received ECT measurement, communicating the respective location and an instruction to direct engine coolant flow from the respective location to one of the heater and engine, and selectively actuating one or more coolant control valves based on the respective location and the instruction.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

In a vehicle that implements engine start-stop functionality, thermal energy from the combustion chamber is directed to other system components, such as a cabin heater, while the engine is off. Removing thermal energy from the combustion chamber cools cylinder walls and has a damaging effect on fuel efficiency. In order to maintain fuel efficiency benefits as a result of engine start-stop events, coolant control valves may be controlled to direct engine coolant to heat the heater or cool the engine while maximizing cylinder wall temperature.

Figure 1:
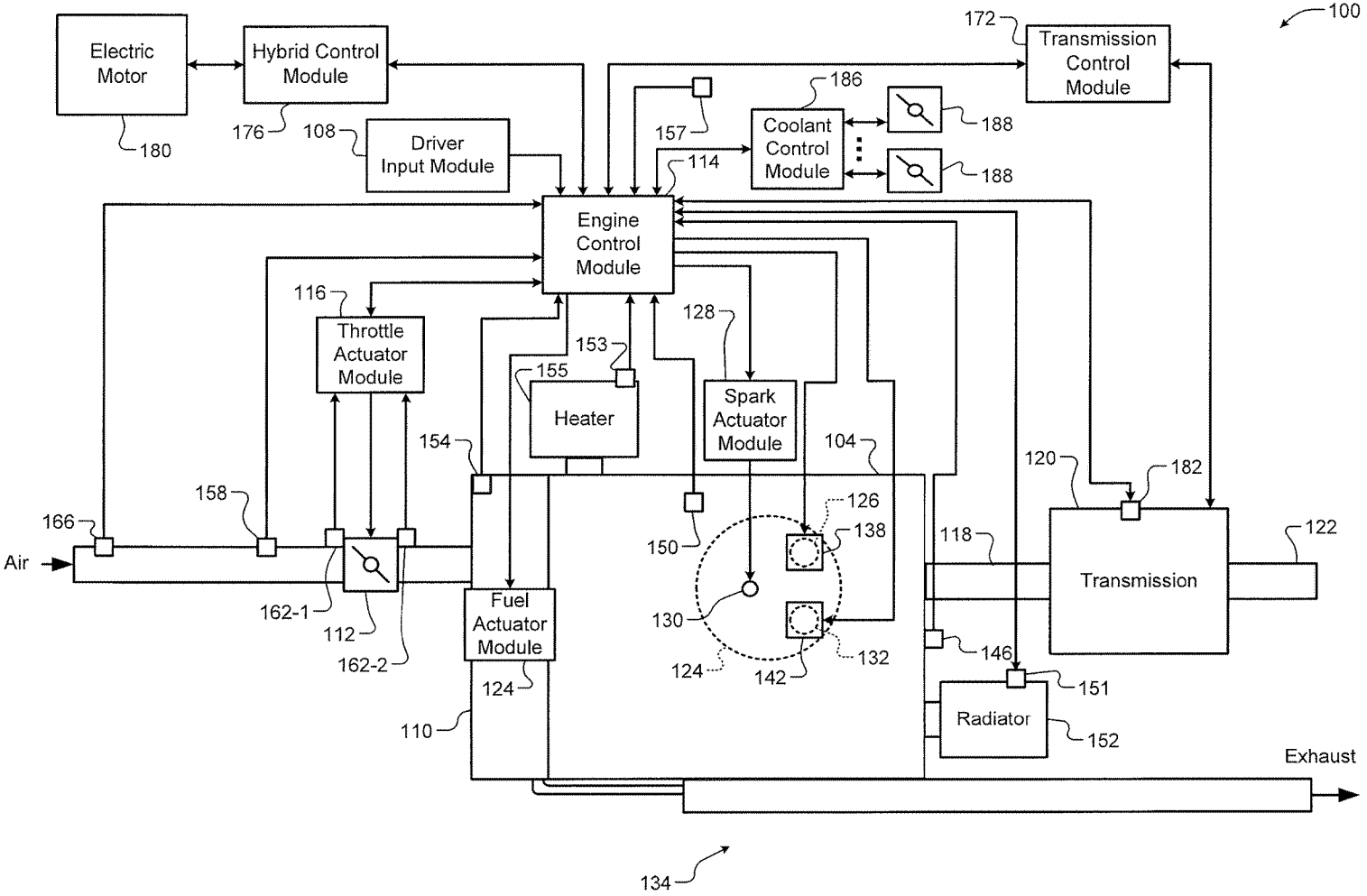
FIG. 1 is a functional block diagram of an example engine system according to the present disclosure.

Referring now to FIG. 1, a functional block diagram of an example engine system 100 is presented. The engine system 100 includes an engine 104 that combusts an air/fuel mixture to produce drive torque for a vehicle based on driver input from a driver input module 108.

Air may be drawn into an intake manifold 110 through a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control the amount of air drawn into the intake manifold 110. A torque converter 118 transfers and multiplies torque from the engine 104 and provides the torque to a transmission 120. The transmission 120 operates in one or more gear ratios to transfer the torque to a driveline 122.

The ECM 114 controls engine start-stop (ESS) of the engine 104. For example, in order to manage fuel efficiency of the system 100, the ECM 114 may stop or turn off (referred to as an engine off event) the engine 104 while a vehicle associated with the system 100 is at rest. In one example, the ECM 114 receives a plurality of vehicle characteristics from various sensors within the system 100.

The plurality of characteristics may include, but are not limited to, a global position, a current vehicle speed, a vehicle break status, and a vehicle throttle status. The ECM 114 may re-start, or turn on (referred to as an engine on event), the engine 104 after a predetermined period, such as, for example only, 2 minutes. In other implementations, the ECM 114 may re-start the engine 104 based on one or more of the plurality of vehicle characteristics. The ECM 114 generates an engine status signal that indicates a current status of the engine 104. For example, the engine status signal indicates whether the engine 104 is currently off.

Air from the intake manifold 110 is drawn into cylinders of the engine 104. While the engine 104 may include more than one cylinder, for illustration purposes a single representative cylinder 124 is shown. The engine 104 may operate using a four-stroke cycle. The four strokes, described below, may be named the intake stroke, the compression stroke, the combustion stroke, and the exhaust stroke. During each revolution of a crankshaft (not shown), two of the four strokes occur within the cylinder 124.

Therefore, two crankshaft revolutions are necessary for the cylinder 124 to experience all four of the strokes.

During the intake stroke, air from the intake manifold 110 is drawn into the cylinder 124 through an intake valve 126. The ECM 114 controls a fuel actuator module 124, which regulates fuel injection to achieve a desired air/fuel ratio. Fuel may be injected into the intake manifold 110 at a central location or at multiple locations, such as near the intake valve 126 of each of the cylinders. In various implementations (not shown), fuel may be injected directly into the cylinders or into mixing chambers associated with the cylinders.

The injected fuel mixes with air and creates an air/fuel mixture in the cylinder 124. During the compression stroke, a piston (not shown) within the cylinder 124 compresses the air/fuel mixture. The engine 104 may be a compression-ignition engine, in which case compression in the cylinder 124 ignites the air/fuel mixture. Alternatively, the engine 104 may be a spark-ignition engine, in which case a spark actuator module 128 energizes a spark plug 130 in the cylinder 124 based on a signal from the ECM 114, which ignites the air/fuel mixture. The timing of the spark may be specified relative to the time when the piston is at its topmost position, referred to as top dead center (TDC).

The spark actuator module 128 may be controlled by a timing signal specifying how far before or after TDC to generate the spark. Because piston position is directly related to crankshaft rotation, operation of the spark actuator module 128 may be synchronized with crankshaft angle.

Generating spark may be referred to as a firing event. The spark actuator module 128 may have the ability to vary the timing of the spark for each firing event. The spark actuator module 128 may even be capable of varying the spark timing for a next firing event when the spark timing is changed between a last firing event and the next firing event.

During the combustion stroke, the combustion of the air/fuel mixture drives the piston away from TDC, thereby driving the crankshaft. The combustion stroke may be defined as the time between the piston reaching TDC and the time at which the piston returns to bottom dead center (BDC).

During the exhaust stroke, the piston begins moving up from BDC and expels the byproducts of combustion through one or more exhaust valves, such as exhaust valve 132. The byproducts of combustion are exhausted from the vehicle via an exhaust system 134.

An intake valve actuator 138 controls actuation of the intake valve 126. An exhaust valve actuator 142 controls actuation of the exhaust valve 132. The intake and exhaust valve actuators 138 and 142 control opening and closing of the intake and exhaust valves 126 and 132, respectively, without one or more camshafts. The intake and exhaust valve actuators 138 and 142 may include, for example, electo-hydraulic actuators, electro-mechanical actuators, or another suitable type of camless valve actuator. Camless intake and exhaust valve actuators enable actuation of each intake valve and exhaust valve of the engine to be controlled independently. The intake and exhaust valve actuators provide what may be referred to as fully flexible valve actuation (FFVA).

Position of the crankshaft may be measured using a crankshaft position sensor 146. Engine speed, engine acceleration, and/or one or more other parameters may be determined based on the crankshaft position. A temperature of the engine coolant may be measured using an engine coolant temperature (ECT) sensor 150. An ECT sensor 150 may be located within the engine 104. Further, an ECT sensor may be located at other locations where coolant is circulated. For example, a temperature of coolant circulating through a radiator 152 may be measured by an ECT sensor 151 and coolant circulating through a heater core of a heater 155 may be measured by an ECT sensor 153.

The heater 155 provides heated air to a vehicle passenger cabin associated with the system 100. A driver or passenger within the vehicle passenger cabin may adjust passenger cabin climate settings to a desired cabin temperature; such that, the heater 155 is turned on to meet the desired temperature within the passenger cabin. The ECM 114 receives a climate settings signal that indicates the desired climate settings. The ECM 114 then controls the heater 155 in response to the climate settings. For example, the climate settings signal may indicate a desired temperature. The ECM 114 compares the desired temperature to a temperature threshold. When the ECM 114 determines the desired temperature is greater than the temperature threshold, the ECM 114 turns the heater 155 on.

Each of the ECT sensors 150, 151, and 153 communicate ECT measurements to the ECM 114. It is understood that the system 100 may include a plurality of ECT sensors in addition to those described herein. For example, the system 100 may include a heater IN ECT sensor, a heater OUT ECT sensor, an engine IN ECT sensor, an engine OUT ECT sensor, and any other suitable sensor.

In some implementations, the system 100 includes an ambient temperature sensor 157 that measures an ambient temperature around a vehicle associated with the system 100. The ambient temperature sensor 157 communicates a current ambient temperature to the ECM 114.

A pressure within the intake manifold 110 may be measured using a manifold absolute pressure (MAP) sensor 154. In various implementations, engine vacuum, which is the difference between ambient air pressure and the pressure within the intake manifold 110, may be measured. A mass flowrate of air flowing into the intake manifold 110 may be measured using a mass air flowrate (MAF) sensor 158. In various implementations, the MAF sensor 158 may be located in a housing that also includes the throttle valve 112.

The throttle actuator module 116 may monitor position of the throttle valve 112 using one or more throttle position sensors (TPS) 162. For example, first and second throttle position sensors 162-1 and 162-2 monitor position of the throttle valve 112 and generate first and second throttle positions (TPS1 and TPS2), respectively, based on the throttle position. A temperature of air being drawn into the engine 104 may be measured using an intake air temperature (IAT) sensor 166. The ECM 114 may use signals from the sensors and/or one or more other sensors to make control decisions for the engine system 100.

A transmission control module 172 may control operation of the transmission 120. The ECM 114 may communicate with the transmission control module 172 for various reasons, such as to share parameters and to coordinate engine operation with operation of the transmission 120. For example, the ECM 114 may selectively reduce engine torque during a gear shift. The ECM 114 may communicate with a hybrid control module 176 to coordinate operation of the engine 104 and an electric motor 180.

The electric motor 180 may also function as a generator and may be used to produce electrical energy for use by vehicle electrical systems and/or for storage in a battery. The electric motor 180 may also function as a motor and may be used, for example, to supplement or replace engine torque output. In various implementations, various functions of the ECM 114, the transmission control module 172, and the hybrid control module 176 may be integrated into one or more modules.

Each system that varies an engine parameter may be referred to as an actuator. Each actuator receives an actuator value. For example, the throttle actuator module 116 may be referred to as an actuator and the throttle opening area may be referred to as the actuator value. In the example of FIG. 1, the throttle actuator module 116 achieves the throttle opening area by adjusting an angle of the blade of the throttle valve 112.

Similarly, the spark actuator module 128 may be referred to as an actuator, while the corresponding actuator value may be the amount of spark advance relative to cylinder TDC. Other actuators may include the fuel actuator module 124. For these actuators, the actuator values may correspond to a number of activated cylinders, fueling rate, intake and exhaust valve timing, boost pressure, and EGR valve opening area, respectively. The ECM 114 may control actuator values in order to cause the engine 104 to generate a desired engine output torque.

The transmission 120 may also include an accumulator module 182 (e.g., including an accumulator). The accumulator selectively accumulates and selectively releases an automatic transmission fluid (ATF). The accumulator module 182 may receive instructions from the ECM 114 and/or transmission control module 172. For example only, the transmission control module 172 may instruct the accumulator module 182 to release ATF from the accumulator and/or to charge the accumulator with ATF.

A coolant control module 186 may control engine coolant flow throughout the system 100. The coolant control module 186 controls an electric pump (not shown) and a plurality of coolant control valves 188. The coolant control module 186 receives instructions from the ECM 114 to direct coolant flow throughout the system 100. The coolant control module 186 selectively actuates one or more of the plurality of coolant control valves 188 in response to the instructions.

In one implementation, the ECM 114 instructs the coolant control module 186 to direct coolant flow within the system 100 based on the engine status signal, the climate settings signal, and the ECT measurements received from the plurality of ECT sensors. For example, the ECM 114 determines whether the engine 104 is off based on the engine status signal. When the ECM 114 determines the engine 104 is off, the ECM 114 determines whether the heater 155 is on based on the climate settings signal.

When the ECM 114 determines the heater 155 is on, the ECM 114 determines a location of the highest measured ECT within the system 100. For example, the ECM 114 receives a plurality of ECT measurements from a plurality of ECT sensors located throughout the system 100. The ECM 114 compares each of the received ECT measurements and selects the highest ECT measurement. The ECM 114 instructs the coolant control module 186 to direct coolant from a location associated with the selected ECT measurement to the heater 155.

Figure 2:
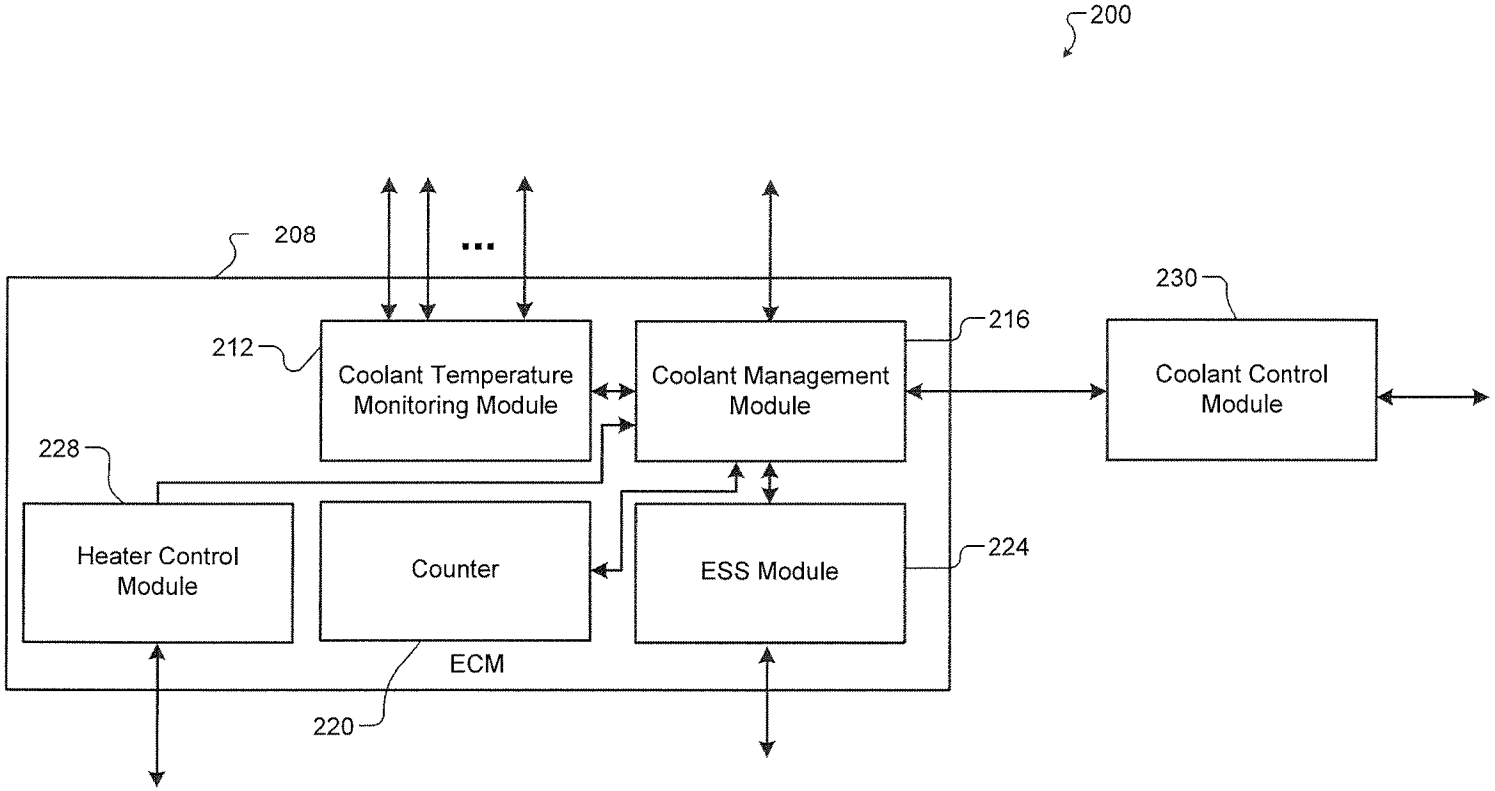
FIG. 2 is a functional block diagram of an example an engine coolant control system according to the present disclosure.

With particular reference to FIG. 2, an engine coolant control system 200 includes an ECM 208 and coolant control module (CCM) 230. The ECM 208 includes a coolant temperature monitoring module 212, a coolant management module 216, a counter 220, an engine start-stop (ESS) module 224, and a heater control module 228.

The coolant temperature monitoring module 212 receives a plurality of engine coolant temperature (ECT) measurements from a plurality of ECT sensors located at various locations within the system 100 as described above. The plurality of ECT sensors include, but are not limited to, a radiator IN ECT sensor, a radiator OUT ECT sensor, a heater IN ECT sensor, a heater OUT ECT sensor, an engine IN ECT sensor, and an engine OUT ECT sensor. It is understood that the plurality of ECT sensors may include other sensors not specifically disclosed herein.

Each of the plurality of ECT sensors measures a temperature of engine coolant at a location associated with the ECT sensor. By way of non-limiting example, a heater, such as the heater 155 as described with reference to FIG. 1, includes at least one ECT sensor, such as a heater IN ECT sensor. The heater IN ECT sensor measures a temperature of engine coolant entering the heater 155. The heater IN ECT sensor communicates the measured ECT and an associated location of the engine coolant to the coolant temperature monitoring module 212.

The coolant temperature monitoring module 212 monitors the received ECT measurements and selects a highest ECT measurement and a lowest ECT measurement. The coolant temperature monitoring module 212 stores each of the highest ECT measurement and an associated location and the lowest ECT measurement and an associated location in an associated memory. The coolant temperature monitoring module 212 continues to receive and monitor received ECT measurements. The coolant temperature monitoring module 212 continues to select a highest ECT measurement and a lowest ECT measurement from the received ECT measurements.

The coolant temperature monitoring module 212 stores the currently selected highest ECT measurement and an associated location and the lowest ECT measurements and an associated location in the associated memory. In other words, the coolant temperature monitoring module 212 overrides previously stored ECT measurements with currently selected ECT measurements. In this manner, the coolant temperature monitoring module 212 continuously selects and stores a highest ECT measurement and an associated location and a lowest ECT measurement and an associated location.

The coolant management module 216 selectively instructs the CCM 230 to direct coolant throughout the system 100. The coolant management module 216 may instruct the CCM 230 to direct coolant to the heater 155 from a location within the system 100 associated with a selected ECT measurement.

For example, as described above, the ECM 208 controls ESS of an engine, for example, the engine 104 as described above. When the ECM 208 stops the engine 104, the ESS module 224 generates an engine status signal indicating that the engine 104 is off. When the ECM 208 re-starts the engine 104, the ESS module 224 generates an engine status signal indicating that the engine 104 is on.

The coolant management module 216 receives the engine status signal. The coolant management module 216 determines whether the engine is off or on based on the engine status signal. When the coolant management module 216 determines that the engine is off, the coolant management module 216 then determines whether the heater 155 is on.

The heater control module 228 receives the climate settings signal described with reference to FIG. 1. The climate settings signal indicates a desired cabin temperature of a driver and/or passenger of a vehicle associated with the system 100. The heater control module 228 selectively controls the heater 155 based on the climate settings signal.

For example, the heater control module 228 determines whether to turn the heater 155 on based on the desired cabin temperature. The heater control module 228 determines whether the desired cabin temperature is above a temperature threshold. The temperature threshold may be a temperature at which the heater is turned on in order to heat the cabin. The temperature threshold may be determined based on an ambient temperature, a preset vehicle setting, or a driver modifiable setting. For example, the temperature threshold may be 60 degrees Fahrenheit when an ambient temperature is below 50 degrees Fahrenheit. It is understood the temperature threshold may be determined in any suitable manner.

When the heater control module 228 determines the desired cabin temperature is above the temperature threshold, the heater control module 228 turns the heater 155 on in order to heat the cabin to the desired cabin temperature. The heater control module 228 communicates a heater status signal to the coolant management module 216. The heater status signal indicates a current status of the heater 155. For example, the heater status signal may indicate the heater 155 is currently on. Conversely, the heater status signal may indicate the heater 155 is currently off.

The coolant management module 216 determines whether the heater 155 is currently on based on the heater status signal. When the coolant management module 216 determines the heater 155 is on, the coolant management module 216 generates a highest coolant measurement request signal. The coolant management module 216 communicates the highest coolant measurement request signal to the coolant temperature monitoring module 212. The coolant request signal instructs the coolant temperature monitoring module 212 to communicate a location of engine coolant within the system 100 associated with the highest measured ECT.

The coolant temperature monitoring module 212 communicates a location associated with the highest ECT measurement stored in the associated memory. By way of non-limiting example, the location associated with highest ECT measurement may be at the radiator IN location. In other words, in this example, the hottest ECT in the system 100 is located at the radiator IN location.

The coolant management module 216 instructs the CCM 230 to direct engine coolant flow from, for example only, the radiator IN location to the heater 155. It is understood that the radiator IN location is merely an illustration of one of a plurality of examples. The CCM 230 may receive instructions to direct engine coolant flow to and from any location within the system 100.

The coolant management module 216 may then decrement the counter 220. The counter 220 may be a preset counter. For example, the counter 220 may be set to 10. The coolant management module 216 decrements the counter after instructing the CCM 230 to direct coolant flow within the system 100.

As described above, the CCM 230 is in communication with a plurality of coolant control valves, such as the plurality of coolant control valves 188. The CCM 230 selectively actuates one or more of the plurality of valves 188 in order to direct engine coolant flow from the instructed location (i.e., the radiator IN location) to the heater. In this manner, the ECM 208 may heat the cabin to a desired temperature, while the engine 104 is in an off state, while maintaining an engine temperature. It is understood that maintaining the engine temperature during an engine off event is advantageous in order to maintain fuel efficiency benefits.

The coolant management module 216 receives a current value of the counter 220. The coolant management module 216 compares the current value of the counter 220 to a counter threshold. For example, the threshold may be 0, or any other predefined value. When the coolant management module 216 determines the current value of the counter 220 is greater than the counter threshold, the coolant management module 216 repeats steps described above. When the coolant management module 216 determines the current value of the counter 220 is less than the counter threshold, the coolant management module 216 does not repeat the steps described above.

In another example, the coolant management module 216 may instruct the coolant control module 230 to direct coolant flow to the engine 104 in order to prevent the engine 104 from overheating, or after boiling, while the engine 104 is off As described above, the coolant management module 216 determines whether the engine is on or off based on the engine status signal. When the coolant management module 216 determines the engine is off, the coolant management module 216 then determines whether the heater 155 is on.

The coolant management module 216 determines whether the heater 155 is currently on based on the heater status signal. When the coolant management module 216 determines the heater 155 is off, the coolant management module 216 then determines whether a current ECT measurement of the engine 104 is above a threshold. For example, the coolant management module 216 requests a current engine 104 ECT measurement from the coolant temperature monitoring module 212. The coolant temperature monitoring module 212, as described above, receives a plurality of ECT measurements and associated locations. The plurality of ECT measurements includes, among a plurality of other ECT measurements, an engine ECT measurement. The coolant temperature monitoring module 212 communicates the current engine ECT measurement associated with the engine 104 to the coolant management module 216.

The coolant management module 216 determines whether the engine ECT measurement is greater than an engine temperature threshold. The engine temperature threshold may be a predetermined value indicative of engine after boil. The coolant management module 216 compares the engine ECT measurement to the engine temperature threshold.

When the coolant management module 216 determines the engine ECT measurement is greater than the engine temperature threshold, the coolant management module 216 generates a lowest coolant measurement request signal. The coolant management module 216 communicates the lowest coolant measurement request signal to the coolant temperature monitoring module 212. The lowest coolant measurement request signal instructs the coolant temperature monitoring module 212 to communicate a location of engine coolant within the system 100 associated with the lowest measured ECT.

The coolant temperature monitoring module 212 communicates a location associated with the lowest ECT measurement stored in the associated memory. By way of non-limiting example, the location associated with lowest ECT measurement may be at the heater OUT location. In other words, in this example, the coolest ECT in the system 100 is located at the heater OUT location.

The coolant management module 216 instructs the CCM 230 to direct engine coolant flow from, for example only, the heater OUT location to the engine 104. It is understood that the heater OUT location is merely an illustration of one of a plurality of examples. The CCM 230 may receive instructions to direct engine coolant flow to and from any location within the system 100.

The coolant management module 216 decrements the counter after instructing the CCM 230 to direct coolant flow within the system 100. The CCM 230 selectively actuates one or more of the plurality of valves 188 in order to direct engine coolant flow from the instructed location (i.e., the heater OUT location) to the engine 104. In this manner, the ECM 208 may cool the engine 104 in order to prevent engine after boil during an engine off event.

The coolant management module 216 receives a current value of the counter 220. The coolant management module 216 compares the current value of the counter 220 to the counter threshold, described above. When the coolant management module 216 determines the current value of the counter 220 is greater than the counter threshold, the coolant management module 216 repeats steps described above. When the coolant management module 216 determines the current value of the counter 220 is less than the counter threshold, the coolant management module 216 does not repeat the steps described above.

As described above, the coolant management module 216 receives the engine status signal. The coolant management module 216 determines whether the engine is off or on based on the engine status signal. In some implementations, when the coolant management module 216 determines the engine is on, the coolant management module 216 instructs the CCM 230 to direct all engine coolant flow to the heater 155. In this manner, a temperature of coolant flowing through the engine 104 will increase, reducing the amount of flow required to meet system requirements. Further, the hotter coolant flowing through the engine 104 will allow the engine 104 to operate at elevated temperatures in order to minimize the impact on fuel efficiency.

Figure 3:
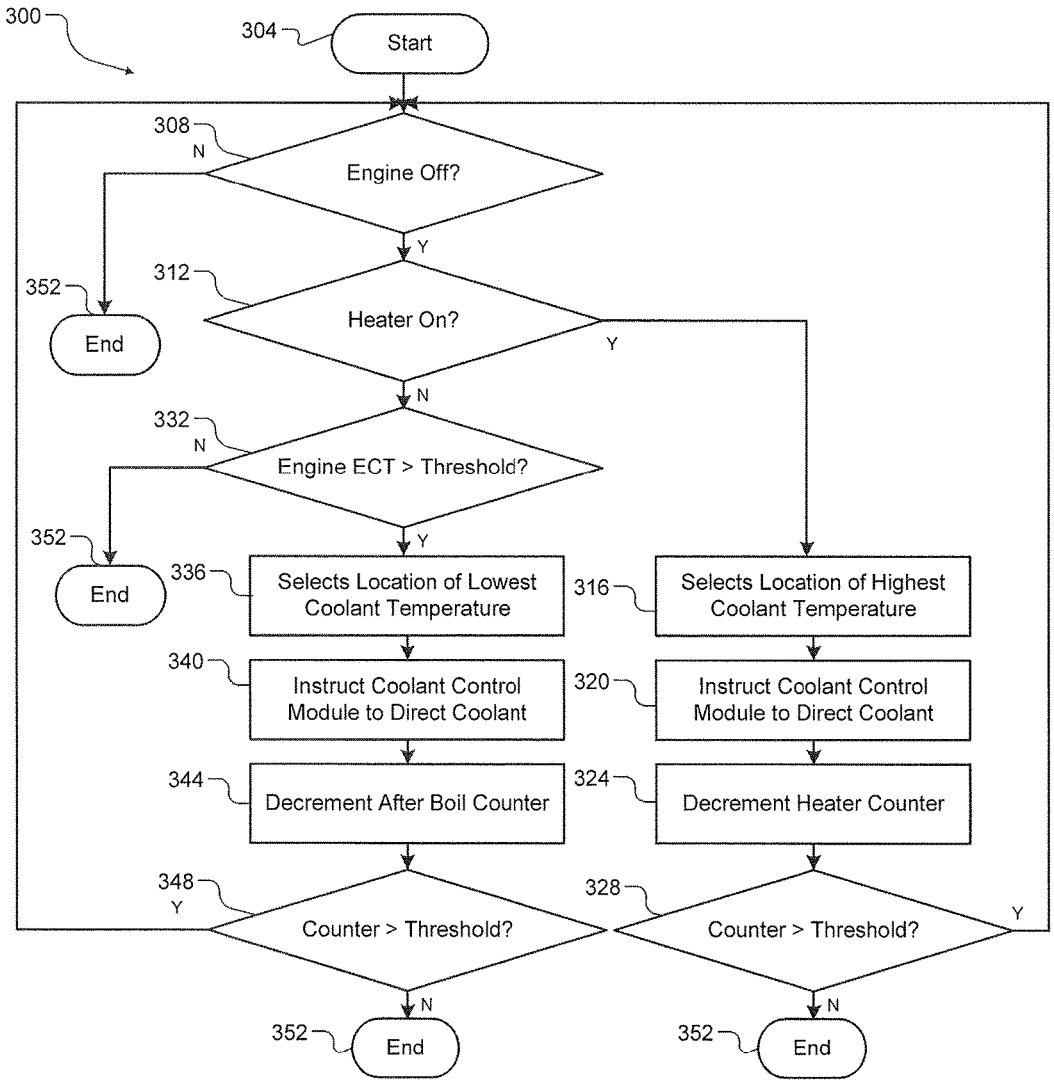
FIG. 3 is a flow diagram depicting an example method for controlling engine coolant within an engine system according to the present disclosure.

With reference to FIG. 3, a flow diagram illustrating an engine off cooling method 300 begins at 304. At 308, the method 300 determines whether the engine 104 is off. If false, the method 300 ends at 352. If true, the method 300 continues to 312. At 312, the method 300 determines whether the heater 155 is on, as described above. If false, the method 300 continues at 332. If true, the method 300 continues at 316.

At 316, the method 300 selects a location within the system 100 associated with the highest ECT measurement. For example, the coolant temperature monitoring module 212 communicates a location associated with the highest ECT measurement to the coolant management module 216. At 320, the method 300, via the coolant management module 216, instructs the CCM 230 to direct engine coolant from the selected location to the heater 155. At 324, the method 300 decrements the counter 220. At 328, the method 300 determines whether a current value of the counter 220 is greater than a threshold. If true, the method 300 continues at 308. If false, the method 300 ends at 352.

At 332, the method 300 determines whether a current ECT measurement associated with the engine 104 is above a threshold. If false, the method 300 ends at 352. If true, the method 300 continues at 336. At 336, the method 300 selects a location within the system 100 associated with a lowest ECT measurement. For example, the coolant temperature monitoring module 212 communicates a location associated with the lowest ECT measurement to the coolant management module 216. At 340, the method 300, via the coolant management module 216, instructs the CCM 230 to direct engine coolant from the selected location to the engine 104. At 344, the method 300 decrements the counter 220. At 348, the method 300 determines whether a current value of the counter 220 is greater than a threshold. If true, the method 300 continues at 308. If false, the method 300 ends at 352.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A system comprising:

a coolant management module that:

determines whether an engine of a vehicle is off;

determines, in response to a determination that the engine is off, whether a heater associated with the engine is on;

receives a plurality of engine coolant temperature (ECT) measurements from a plurality of ECT sensors and respective locations associated with the received ECT measurements; and communicates the respective location and an instruction to direct engine coolant flow from the respective location to one of the heater and engine; and a coolant control module that selectively actuates one or more coolant control valves based on the respective location and the instruction, wherein the coolant management module, in response to determining that the engine is off and the heater is on, instructs the coolant control module to direct, using a pump configured to operate when the engine is off, engine coolant flow from a location associated with a highest one of the received ECT measurements to the heater, and wherein the coolant management module, in response to determining that the engine is off, the heater is off, and a current engine temperature is above a predetermined threshold, instructs the coolant control module to direct, using the pump, engine coolant flow from a location associated with a lowest one of the received ECT measurements to the engine.

2. A system comprising:

a coolant management module that:

determines whether an engine of a vehicle is off;

determines, in response to a determination that the engine is off, whether a heater associated with the engine is on;

receives a plurality of engine coolant temperature (ECT) measurements from a plurality of ECT sensors and respective locations associated with the received ECT measurements; and communicates the respective location and an instruction to direct engine coolant flow, using a pump configured to operate when the engine is off, from the respective location to one of the heater and engine;

a coolant control module that selectively actuates one or more coolant control valves based on the respective location and the instruction; and a preset counter, wherein the coolant management module decrements the counter in response to communicating the respective location and the instruction, wherein the coolant management module compares a current value of the counter with a counter threshold, wherein the coolant management module determines whether the engine is off in response to a determination that the current value of the counter is greater than the counter threshold, and wherein the coolant management module does not determine whether the engine is off in response to a determination that the current value of the counter is less than the counter threshold.

3. A method comprising:

determining whether an engine of a vehicle is off;

determining, in response to a determination that the engine is off, whether a heater associated with the engine is on;

receiving one of a plurality of engine coolant temperature (ECT) measurements and a respective location associated with the received ECT measurement;

communicating the respective location and an instruction to direct engine coolant flow from the respective location to one of the heater and engine; and selectively actuating one or more coolant control valves based on the respective location and the instruction, wherein in response to determining that the engine is off and the heater is on, selectively directing, using a pump configured to operate when the engine is off, engine coolant flow from a location associated with a highest one of the received ECT measurements to the heater, and wherein in response to determining that the engine is off, the heater is off, and a current engine temperature is above a predetermined threshold, selectively directing, using the pump, engine coolant flow from a location associated with a lowest one of the received ECT measurements to the engine.

4. The method of claim 3 further comprising:

decrementing a preset counter in response to communicating the respective location and the instruction;

comparing a current value of the counter with a counter threshold;

determining whether the engine is off in response to a determination that the current value of the counter is greater than the counter threshold; and not determining whether the engine is off in response to a determination that the current value of the counter is less than the counter threshold.

* * * * *